US011384492B2

(12) United States Patent
Schaaf et al.

(10) Patent No.: US 11,384,492 B2
(45) Date of Patent: Jul. 12, 2022

(54) FENCE SYSTEM AND METHOD OF USE

(71) Applicant: SOX, LLC, Boca Raton, FL (US)

(72) Inventors: Daniel Shane Schaaf, Boca Raton, FL (US); Ryan Leeds, Boca Raton, FL (US); Brian Fischer, Boca Raton, FL (US)

(73) Assignee: SOX, LLC, Boca Raton, FL (US)

( * ) Notice: Subject to any disclaimer, the term of this patent is extended or adjusted under 35 U.S.C. 154(b) by 105 days.

(21) Appl. No.: 16/411,786

(22) Filed: May 14, 2019

(65) Prior Publication Data

US 2019/0352867 A1 Nov. 21, 2019

Related U.S. Application Data

(60) Provisional application No. 62/671,223, filed on May 14, 2018.

(51) Int. Cl.
*E01F 7/02* (2006.01)

(52) U.S. Cl.
CPC ..... *E01F 7/025* (2013.01)

(58) Field of Classification Search
CPC ..... E01F 7/00; E01F 7/02; E01F 7/025; E01F 7/04; E01F 7/045
USPC ..... 256/12.5, 13, DIG. 2
See application file for complete search history.

(56) References Cited

U.S. PATENT DOCUMENTS

| | | | | |
|---|---|---|---|---|
| 4,279,535 | A | 7/1981 | Gagliardi et al. | |
| 6,692,188 | B1 | 2/2004 | Walker et al. | |
| 8,747,027 | B1 * | 6/2014 | Singleton | E02D 3/005 405/302.7 |
| 9,777,447 | B1 | 3/2017 | Hipfl | |
| 10,145,080 | B2 * | 12/2018 | Segroves | E01F 7/02 |
| 2002/0172564 | A1 * | 11/2002 | Brown | E01F 7/025 256/12.5 |
| 2006/0133897 | A1 | 6/2006 | Allard et al. | |
| 2008/0157044 | A1 | 7/2008 | Barfield et al. | |
| 2014/0154018 | A1 | 6/2014 | Singleton et al. | |
| 2016/0237635 | A1 | 8/2016 | Schaaf | |
| 2016/0362865 | A1 | 12/2016 | Segroves et al. | |

FOREIGN PATENT DOCUMENTS

| | | | | |
|---|---|---|---|---|
| EP | 1788168 | A1 * | 5/2007 | E04H 17/12 |
| FR | 2079966 | A5 * | 11/1971 | E01F 7/025 |

OTHER PUBLICATIONS

ISR and Written Opinion on PCT/US19/32160.

* cited by examiner

*Primary Examiner* — Josh Skroupa
(74) *Attorney, Agent, or Firm* — Yong Chen

(57) ABSTRACT

A fence includes a wall panel portion having an upper edge and a lower edge, and a plurality of tubular pockets running across the wall panel between the upper edge and the lower edge. The tubular pockets each configured to receive a mounting post. The upper edge and the lower edge can each include a channel in which a draw cord is threaded. The fence can further include an apron portion extending from the lower edge of the wall panel portion. Methods of installing the fence are also provided.

12 Claims, 8 Drawing Sheets

FENCE SYSTEM AND METHOD OF USE

CROSS REFERENCE TO RELATED APPLICATION

This application claims the benefit of priority to U.S. Provisional Application No. 62/671,223, filed May 14, 2018, the disclosure of which is incorporated by reference herein in its entirety.

BACKGROUND

A silt fence, usually made of porous fabric, is often used as a material barrier for construction sites, landscaping operations, surface water ways (such as creeks and rivers), river banks or shores, etc. Silt, clay, sediment, and other ground material may be swept away by wind, water, and gravity. The fabric pools such ground material carried in the runoff and retain the material by the settling processes, e.g., in creeks, rivers, or still bodies of water. As such, traditional silt fences have been used to control the displacement of silt and its subsequent deposition in undesirable locations.

A traditional silt fence can be just a semi-permeable fabric installed vertically on the ground, e.g., by stapling the fabric on posts or stakes driven to the ground. These silt fences suffer several drawbacks. For example, the coupling between the fabric and the posts (or stakes) are not secure enough and can be easily undone or torn during use, resulting in weak or leaky areas which allow excessive silt to pass through. The fabric material and its construction in traditional silt fence is often of insufficient strength, resulting in excessive stretching and sagging of the fence, and failure to trap silt due to inadequate settling time. Also, installation of traditional silt fences often requires digging a trench to bury and anchor a bottom part of the fabric material to add stability for the fence, but such a procedure can be labor intensive.

SUMMARY OF THE INVENTION

In one aspect, the present disclosure provides a fence or fencing system. In some embodiments, the fence comprises a wall panel portion having an upper edge and a lower edge, an apron portion extending from the lower edge of the wall panel portion, the apron portion having a distal spaced from the lower edge, and a plurality of tubular pockets running across the wall panel between the upper edge and the lower edge, the tubular pockets each configured to receive a mounting post therein.

In other embodiments, the fence does not have a portion that is laterally positioned when installed. In the latter case, the fence can include a wall panel portion having an upper edge and a lower edge, wherein the wall panel comprises a first channel proximate the upper edge in which a first draw cord is threaded, and a second channel proximate the lower edge in which a second draw cord is threaded. The fence further includes a plurality of tubular pockets running across the wall panel between the upper edge and the lower edge, the tubular pockets each configured to receive a mounting post therein.

In some embodiments, the wall panel portion and/or the apron portion is formed of a flexible fabric material, such as a knitted polyethylene material. For example, for a fence system having an apron portion, the wall panel portion and the apron portion can be formed of a one-piece flexible fabric material.

The tubular pockets of the fence can be attached to the wall panel portion, or can be formed by a fold(s) of the wall panel portion. The fence can further comprise at least one grommet near the upper edge and proximate to at least one of the plurality of tubular pockets. The tubular pockets can each further include an inserted mounting posts, where the mounting posts can be coupled to the wall panel portion by a fastening mechanism, such as a zip tie, a knotted rope, etc.

The wall panel portion of the fence may include a channel proximate to the upper edge in which a first draw cord is threaded. For a fence with an apron portion, the apron portion may include a channel proximate its distal edge in which a second draw cord is threaded. For a fence without an apron portion, the wall panel portion can include a channel proximate the lower edge in which a second draw cord is threaded.

In another aspect, methods of installing a fence system is provided. For example, to install a fence having an apron portion, a plurality of mounting posts can be inserted each into one of the plurality of tubular pockets, axial positions of the mounting posts can be fixed relative to the tubular pockets, the plurality of the mounting posts are driven into the ground, and the apron portion is laid laterally on the ground. The distal edge of the apron portion can be further secured on the ground. To install a fence without an apron but has a channel near the lower edge of the wall panel with a drawing cord run therethrough, a similar method (except relating to the apron portion) can be used. The draw cord in the channel can be tensioned by using a plurality of securing stakes to secure it onto the ground, or wrapping around and/or tying the draw cord onto one or more of the mounting post(s).

BRIEF DESCRIPTION OF THE DRAWINGS

The accompanying drawings, which are incorporated in, and constitute a part of the specification, illustrate exemplary implementations and embodiments of the invention and, together with the detailed description, serve to explain the principles of the invention. In the drawings, where like reference numerals denote like elements.

DETAILED DESCRIPTION OF CERTAIN EMBODIMENTS

In one aspect, the present invention relates to a fence system that can be used to control the movement of silt and filter out undesirable substances from a water ecosystem. The fence system can be installed in various sites that are susceptible to problems caused by the silt carried by storm water, such as in construction sites, lakes, creeks, rivers, and other waterways. The silt fence system is environment friendly and safe for wildlife, fish and other aquatic habitats. Therefore, some embodiments of the silt fence of the present invention are particularly useful for in-water work and/or perimeter control to safeguard water quality of the work location. In addition to silt fence application, the fence system disclosed herein can also be used to control the undesired migration of other solid material, such as snow.

Figure 1A:
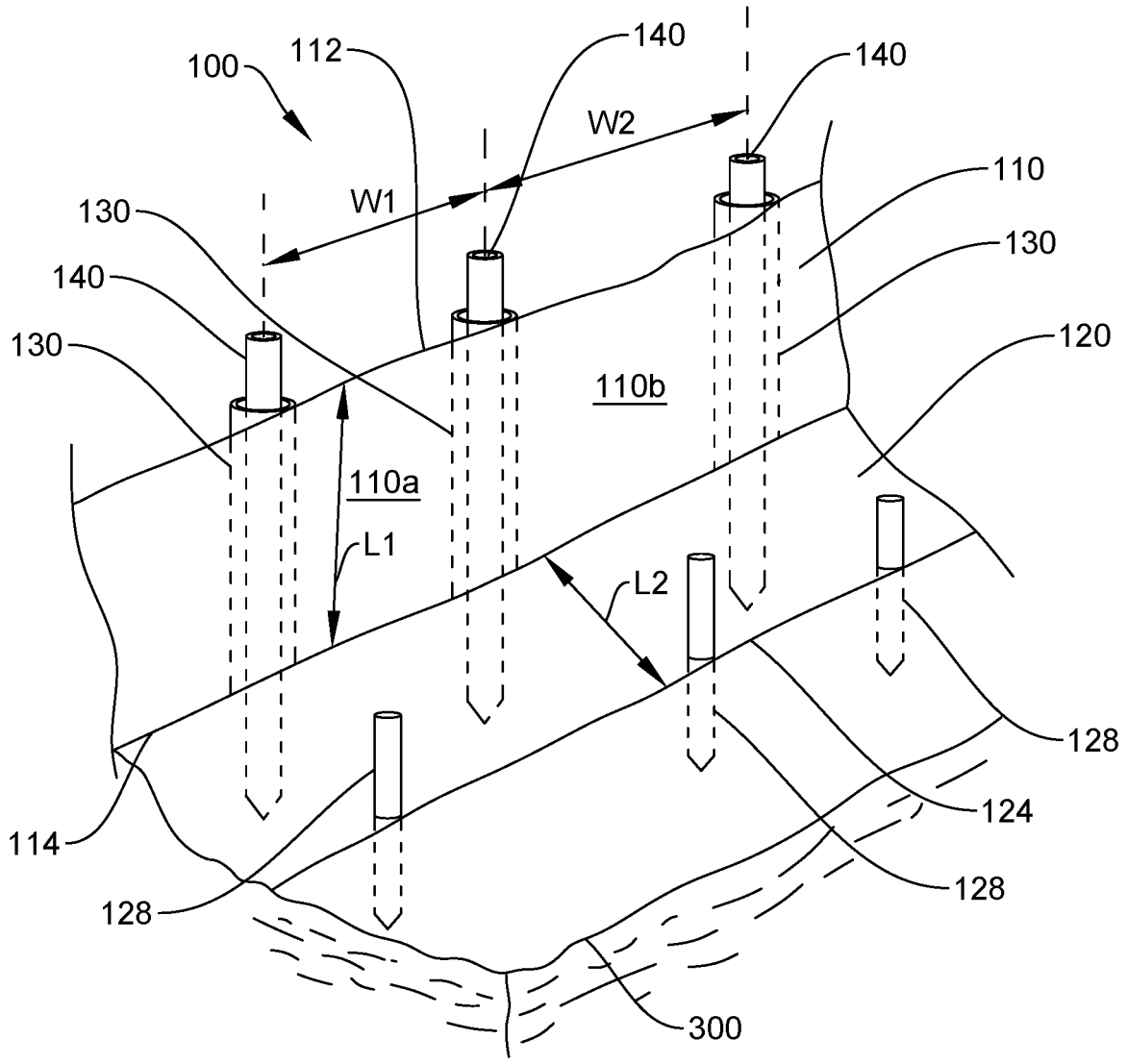
FIGS. 1A and 1B are schematic views of a fence system having an apron portion according to some embodiments of the present invention.
Figure 1B:
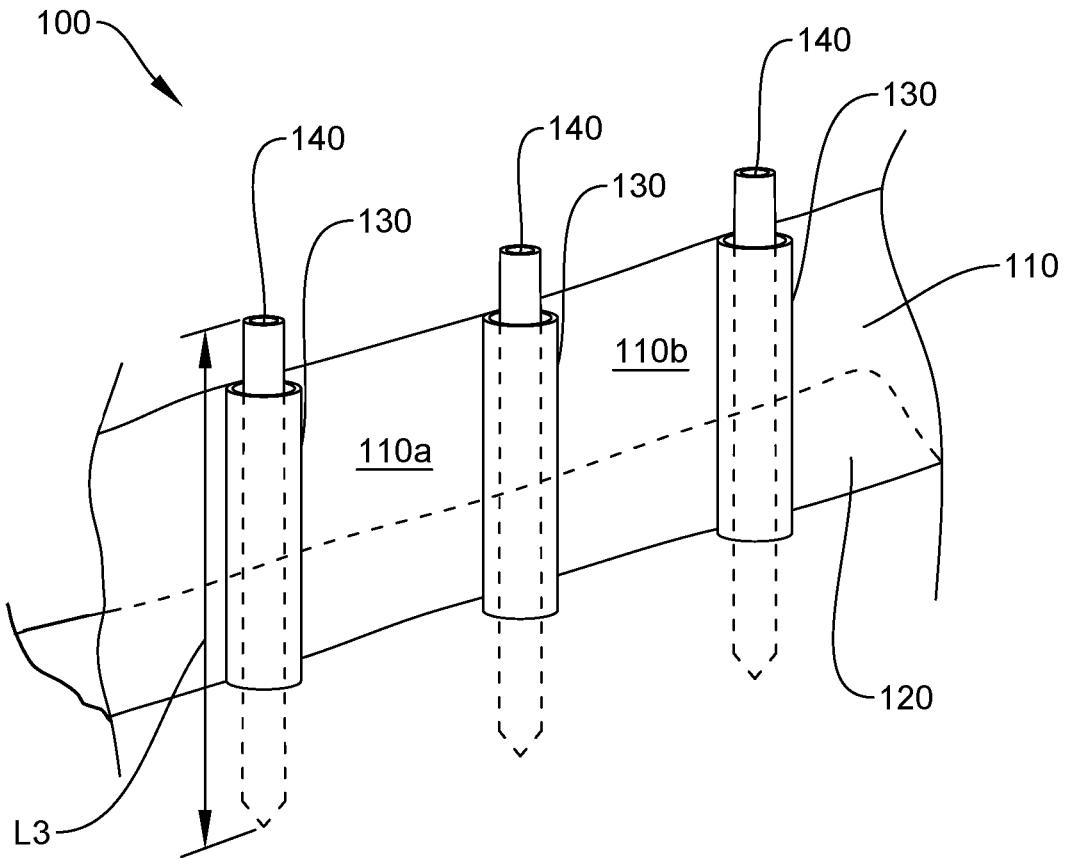

FIG. 1A is a schematic perspective view (looked from downstream) of one embodiment of a fence 100 of the present disclosure. FIG. 1B is a schematic perspective view (looked from upstream) of one embodiment of a fence 100 of the present disclosure. Referring to both FIGS. 1A and 1B, the fence 100 has a wall panel portion 110. The wall portion 110 has an upper edge 112 and a lower edge 114, and a vertical length L1 defined between the upper edge 112 and the lower edge 114. An apron portion 120 extends from the lower edge 114 of the wall panel 110. The apron portion 120 has a lateral length of L2, and a distal edge 124. The fence 100 includes a plurality of tubular pockets 130 (only three are shown) running cross the wall panel portion between the upper edge 112 and the lower edge 114. The tubular pockets 130 are attached to the wall portion 110. The apron portion 120 is not attached with the tubular pockets 130.

As shown in FIG. 1, the three tubular pockets 130 can define two subareas 110*a*, 110*b* on the wall panel portion 110. The width of the subareas, W1 and W2 (or the spacing between each neighboring two pockets) can be the same or different, and can be selected based on the specific applications of the fence and the location in which the fence is to be installed. For example, the width of each subarea can vary between about 0.5 m to about 20 m.

The vertical lengths (or height) L1 of subareas 110*a* and 110*b* of the wall panel portion 110 can be the same or different, and can be selected based on the specific applications of the fence and the location where the fence is to be installed. For example, the vertical length L1 of a subarea of the wall panel portion 110 can be from about 0.5 m to about 2 m. The vertical length of each of the tubular pockets 130 can be same or different, and can be greater or smaller than, or about the same as L1. The lateral length L2 of the apron portion can be selected based on specific applications. For example, L2 can be from 0.5 m to about 2 m.

Each of the wall portion 110, apron portion 120, and tubular pockets 130 can be formed from a same material or from different materials. The materials may be selected based upon the desired strength, longevity, overall cost of the fence, the location of the installation of the fence (e.g., flowing speed and silt content of the water in a water system), etc. In some embodiments, the material used to construct the wall portion, the apron portion, and/or the tubular pockets can be a flexible fabric material. In some embodiments, the flexible fabric material can be a mesh, woven, braided, or knitted form, although other forms can also be employed herein. In particular embodiments, the flexible fabric material can be a knitted fabric. The flexible fabric may have a single layer or more than one layer. For example, the fabric can have a two-layer forming a pocket structure therebetween, with one or more filter media inserted into the pocket structure. The filter media can be in the forms of powders, fibers, particulates and other forms, and can be made of porous silica, glass, polymeric materials, and other materials with suitable packing density to filter solid matters exceeding certain size thresholds, and/or those materials having appropriate chemical compositions suitable to absorb certain pollutants or contaminants such as heavy metals or toxic chemicals. In some embodiments, the fabric may have a basis weight of about 4-5 oz per square yard. Preferably, the fabric material does not leach any undesirable substance into a water system where it is installed. In some embodiments, the flexible fabric is made of knitted polyethylene fibers. Such material will not unravel if torn, unlike traditional silt fence products, and therefore provide better reliability in preventing contamination by undesired silt migration to sensitive areas.

In some embodiments, the wall panel portion 110 and the apron portion 120 are formed from a one-piece flexible material. In some embodiments, the apron portion 120 and the wall panel portion are made separately by the same or different material, and are then joined together. For example, the apron portion may be formed by a heavier and tightly woven geotextile material, and is then sewn to the wall panel portion. Additionally, the apron portion may be attached with additional weights to ensure good contact with the installation ground.

As illustrated in FIGS. 1A and 1B, the tubular pockets 110 each are configured to receive a mounting post 140. The mounting post can be generally cylindrical, but can take other cross section shapes, such as oval, multilateral, T-shape, etc. The mounting post 140 can have a vertical length L3 that is greater than that of the tubular pocket where it is fitted. The lower end of the mounting post 142 can be generally pointed to facilitate the installation of the mounting post into the ground 300. The mounting post can be made from any suitable material such as wood, metal, and plastics.

Figure 2A:
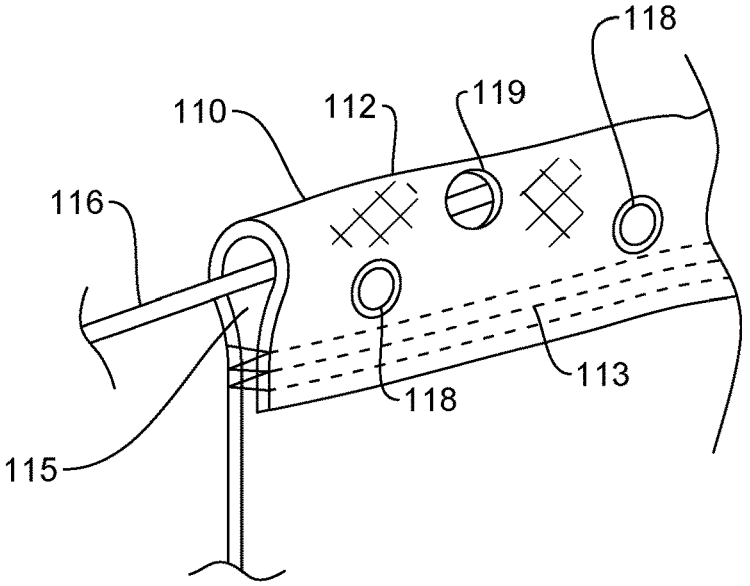
FIGS. 2A and 2B are schematic views of portions of a fence system according to some embodiments of the present invention.

In some embodiments, the fabric material along the upper edge 112 of the wall panel portion 110 can be folded onto itself, and the two layer of the fabric material can be sewn, riveted, buttoned up, or otherwise joined to create a channel 115 in which a draw cord 116 may run through, as illustrated in FIG. 2A. FIG. 2A also shows the sewing lines 113 for closing the channel, as well as grommets 118 disposed near the upper edge of the wall panel portion, and opening 119 on the wall panel portion exposing a section of the draw cord 116. The grommets may be used to facilitate the coupling between mounting posts and the fence. The opening 119 can be used for coupling between reinforcing ropes with the fence via the draw cord.

Figure 2B:
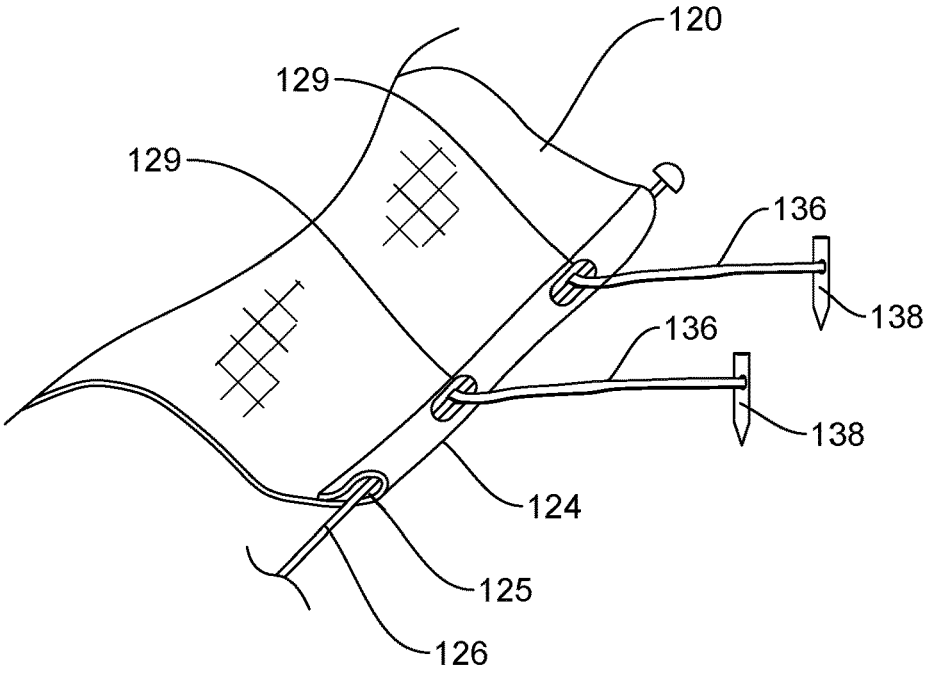

In some embodiments, the fabric material along the distal edge 124 of the apron portion 120 can be similarly folded and closed to form a channel 125 in which a draw cord 126 may be threaded, as shown in FIG. 2B. The channel 125 may have openings 129 exposing sections of draw cord 126, which may be used as access points for coupling a fastening rope for further securement of the apron portion. Alternatively, the draw cord 126 may be directly pinned the ground by stakes with a hook or grabbing portion to hold down the draw cord.

The draw cords as used with the fabric of the present disclosure can be made from synthetic engineering plastics, such as Nylon 6 or Nylon 66, and can have a gauge of 5 mm or greater and a strength sufficient to hold the fabric in an uptight position when tensioned properly. While not shown, it is understood that sections of the draw cord 116 can also be used to wrap around or tie the top of the mounting posts.

Figure 3A:
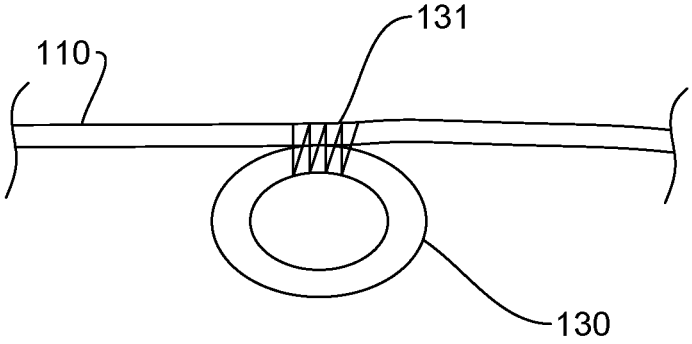
FIGS. 3A and 3B are schematic top views of different configurations of a tubular pocket of a fence system according to some embodiments of the present invention.
Figure 3B:
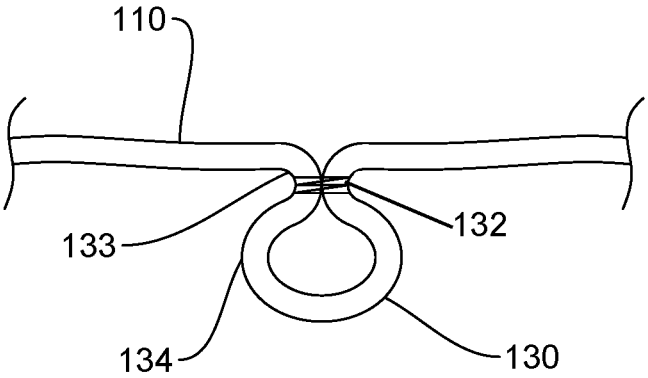

In some embodiments, and as illustrated in FIG. 3A, the tubular pocket 130 can be formed separately and coupled to the wall panel portion 110 by a coupling mechanism 131, e.g., by sewing, riveting or otherwise joining a portion of the pocket to one side of the wall panel portion 110. In other embodiments, and as illustrated in FIG. 3B, the tubular pocket 130 be formed by folding a portion of flexible material of the wall panel portion 110, and closing the folded portion 134 by a coupling mechanism 132, e.g., by sewing, riveting or otherwise joining the base sections 133 of the folded portion 134, thereby forming the tubular pocket 130.

Figure 4A:
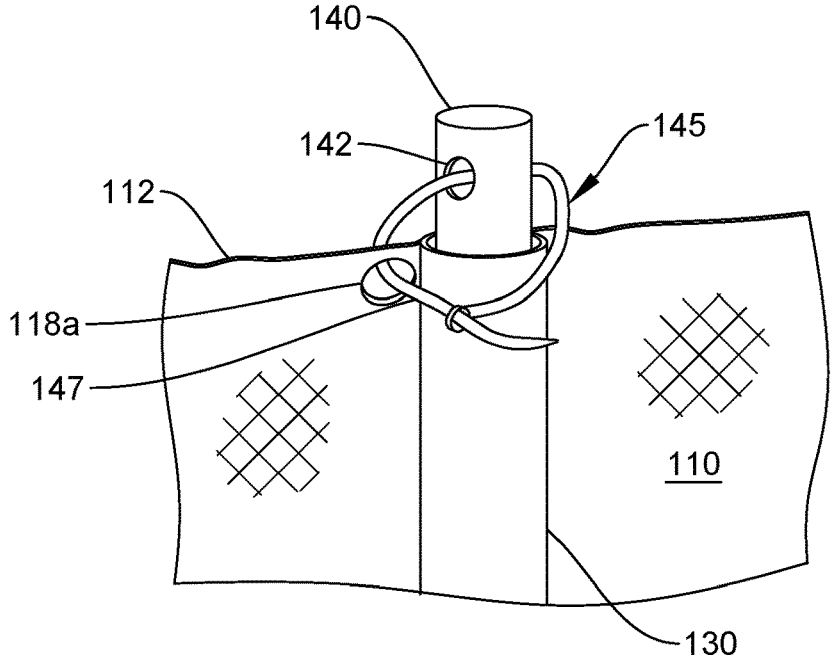
FIGS. 4A and 4B depicts example couplings between a mounting post and a wall panel portion of a fence system according to some embodiments of the present invention.
Figure 4B:
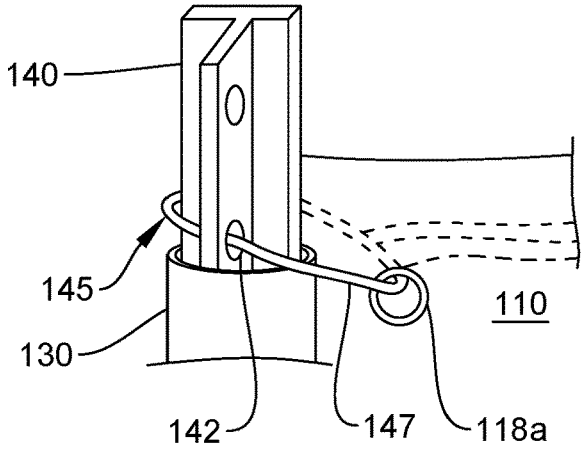

The mounting posts can be inserted into the tubular pockets before installation of the fence. When a desired insertion position is obtained, it is necessary to prevent further axial movement between the mounting posts and the tubular pockets. This can be accomplished in a variety of ways. For example, as illustrated in FIGS. 4A (showing a cylindrical mounting post) and 4B (showing a mounting post with a T-shaped cross section), a portion of a mounting post 140 exposed above the tubular pocket 130 can have a through hole 142, and fastening mechanism (e.g., a zip tie or a wire) 145 can have an elongated element 147 threaded therethrough and passing a rivet hole 118*a* near the upper edge 112 of the wall panel portion 110 and proximate the tubular pocket 130, thereby securing the mounting post 140 relative the tubular pocket 130. The tubular pocket 130 near its upper end may also be provided with rivet hole(s) to facilitate the securement of the mounting posts. In addition to or in the alternative to a through hole, the mounting post can have other features, such as hooks, loops, grooves that may be used to facilitate its coupling with the wall panel and/or the tubular pocket.

In some embodiments, the wall panel portion, the apron portion, and the tubular pockets are all formed from a one-piece flexible fabric material as described herein.

The fence 100 can be installed by inserting the mounting posts 140 into the respective pockets 130, and then driving the mounting posts 140 generally vertically into the ground 300 (see FIG. 1A). In such a manner, the wall panel portion 110 is substantially vertical to the ground after installation. The apron portion 120 can be laid laterally upstream (i.e., extending against the direction in which the silt tends to migrate) on the ground. The distal edge 124 of the apron portion can be fixed to the ground by stakes 128 (see FIG. 1A) that are driven through the apron material directly. Alternatively or additionally, the distal edge 124 can be secured on the ground by using ropes 136 extending out from the openings 129 and coupled to the draw cord 126, and the distal end of the ropes 136 are tethered to stakes 138 which can be driven to the ground (see FIG. 2B). This extended mode of securement allows the installation of the apron portion where the ground proximate the distal edge of the apron portion does not offer sufficient support. In some instances, the distal edge 124 can be secured to the ground by fixing the two outer ends of the draw cord 126 to the ground, by fixing the exposed segments of the draw cord 126 directly to the ground by stakes. In certain instances, e.g., when the fence is installed in a water system (a bottom portion of the wall panel portion are submerged in water), the distal edge 124 of the apron can be laid laterally in water without fixation by stakes. The moving silt can quickly bury and immobilize the apron portion.

Figure 6A:
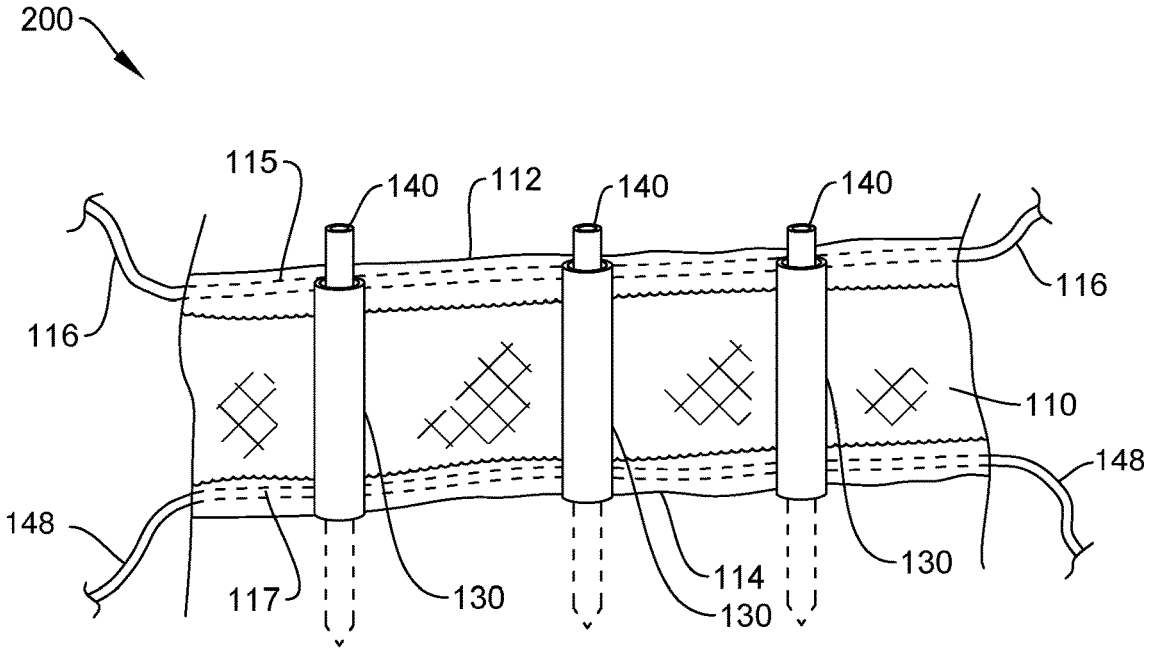
FIGS. 6A-6D are schematic views of a fence system without an apron portion according to certain embodiments of the present invention.
Figure 6B:
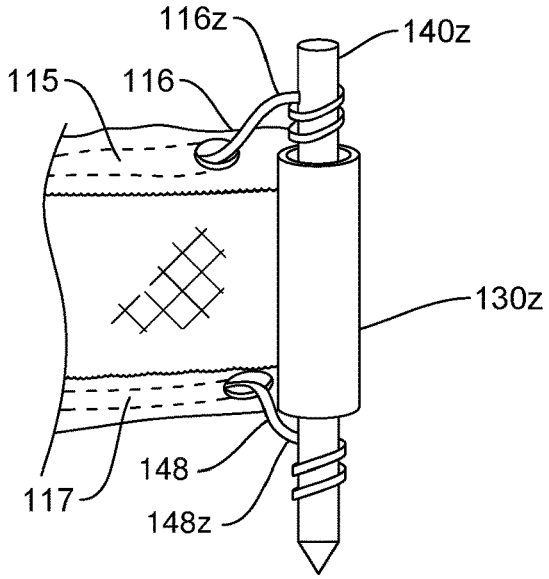

FIGS. 6A and 6B illustrate another embodiment of the fence system 200 of the present invention without an apron portion that is laid horizontally or laterally when the fence is erected. As shown in FIGS. 6A and 6B, similar to what have been described in connection with FIGS. 1A, 1B, 2A, 2B, 3A, 3B, 4A, and 4B, the fence 200 includes wall panel portion 110 and a plurality of tubular pockets 130 attached in each of which a mounting post 140 is inserted. However, this fence system does not include an apron portion. The wall panel portion near the upper edge 112 has a channel 115, which can be formed by folding the fabric material of the wall panel at the upper edge, in which a draw cord 116 is threaded. The wall panel portion near the lower edge 114 also has a channel 117, in which a draw cord 148 is threaded. The draw cords 116 and 148 can be tensioned to provide extra support to the wall panel portion, thereby added stability to the fence system. For example, an end portion 116*z* of the draw cord 116 can be wrapped and/or tied up at an outermost mounting post 140*z* (e.g., at an exposed portion of the post above the tubular pocket 130*z* as shown), and an end portion 148*z* of the draw cord 148 can also be wrapped and/or tied up at an outermost mounting post 140*z* (e.g., at a portion lower than the tubular pocket 130*z* as shown). Alternatively, such securement between the draw cords 116 and 148 can be between intermediate exposed loops of the cords and intervening mounting posts between the outermost mounting posts.

Figure 6C:
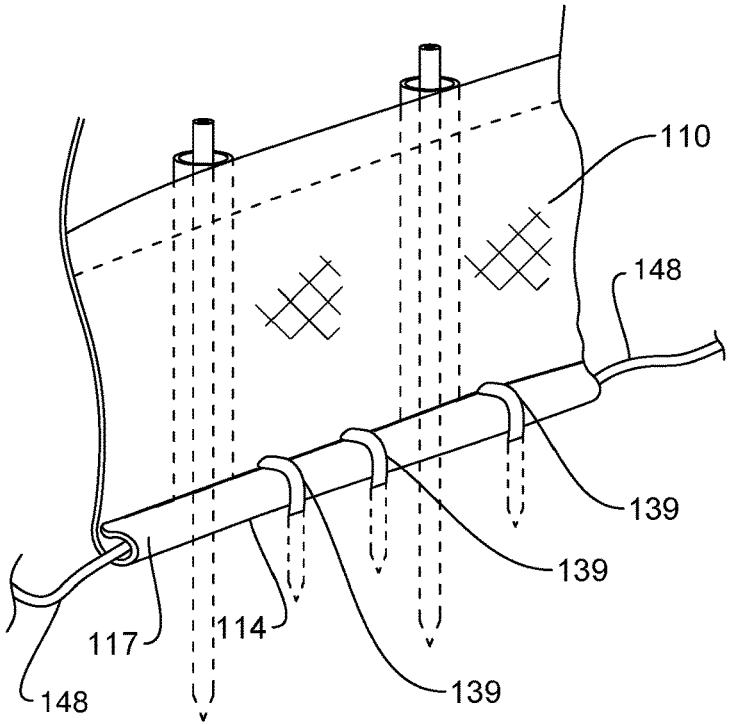
Figure 6D:
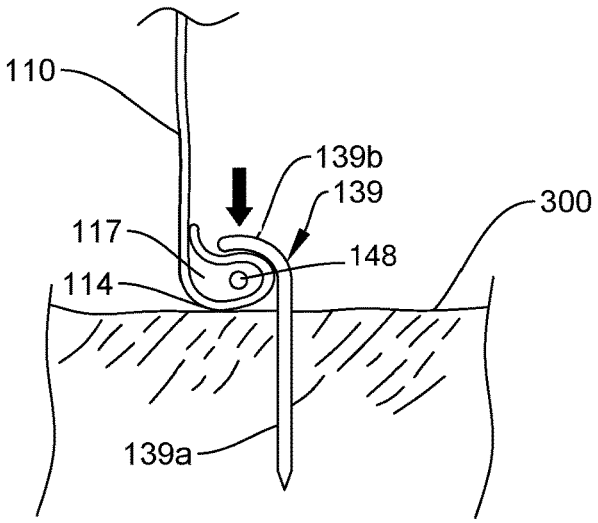

FIGS. 6C and 6D illustrate an alternative embodiment of securing the bottom of the wall panel portion 110, which has near its lower edge 114 also a channel 117, in which a draw cord 148 is threaded. Here, a plurality of securing stakes 139 are used along the channel 117 to hold down the draw cord 148 on the ground 300. The securing stakes 139 can each include a bottom portion 139*a* having a pointed tip for penetrating into the ground, and a top portion 139*b* which can include a bend to hook or grab the draw cord 148. When the securing stakes are driven down the ground 300, they can hold the draw cord 148 tightly onto the ground, thereby providing a better closure between the bottom edge of the wall panel and the ground. The distance between neighboring securing stakes 139 can be the same, e.g., every 1 foot, every 2 feet, every 3 feet, or it can be varied depending on the installation location and condition.

The securement by the draw cords are especially important at the foot of the wall panel which is primarily responsible for blocking the migrating silt and other ground material. Tensioning the bottom part of the wall panel, e.g., by securing the draw cord in the bottom channel of the wall panel to the mounting posts and/or to the securing stakes as shown in FIGS. 6A-6D allows an easy installment of the fence system without the need to dig a trench. The lower edge of the wall panel can be simply left to rest on the ground without being buried because the lower edge is sufficiently reinforced by the properly tensioned draw cord to withstand the impact of the migrating silt, thereby reducing chance of damage or leak.

The fence systems described herein can be installed on the ground in a way where all the installation locations of the mounting posts form a straight line, as shown in FIGS. 1A/1B and FIG. 6A. Alternatively, the mounting posts can be installed in any other geometry as required or desired for any specific applications, e.g., a curved arrangement for protecting a particular area of a water system (shown in FIG. 5).

Figure 5:
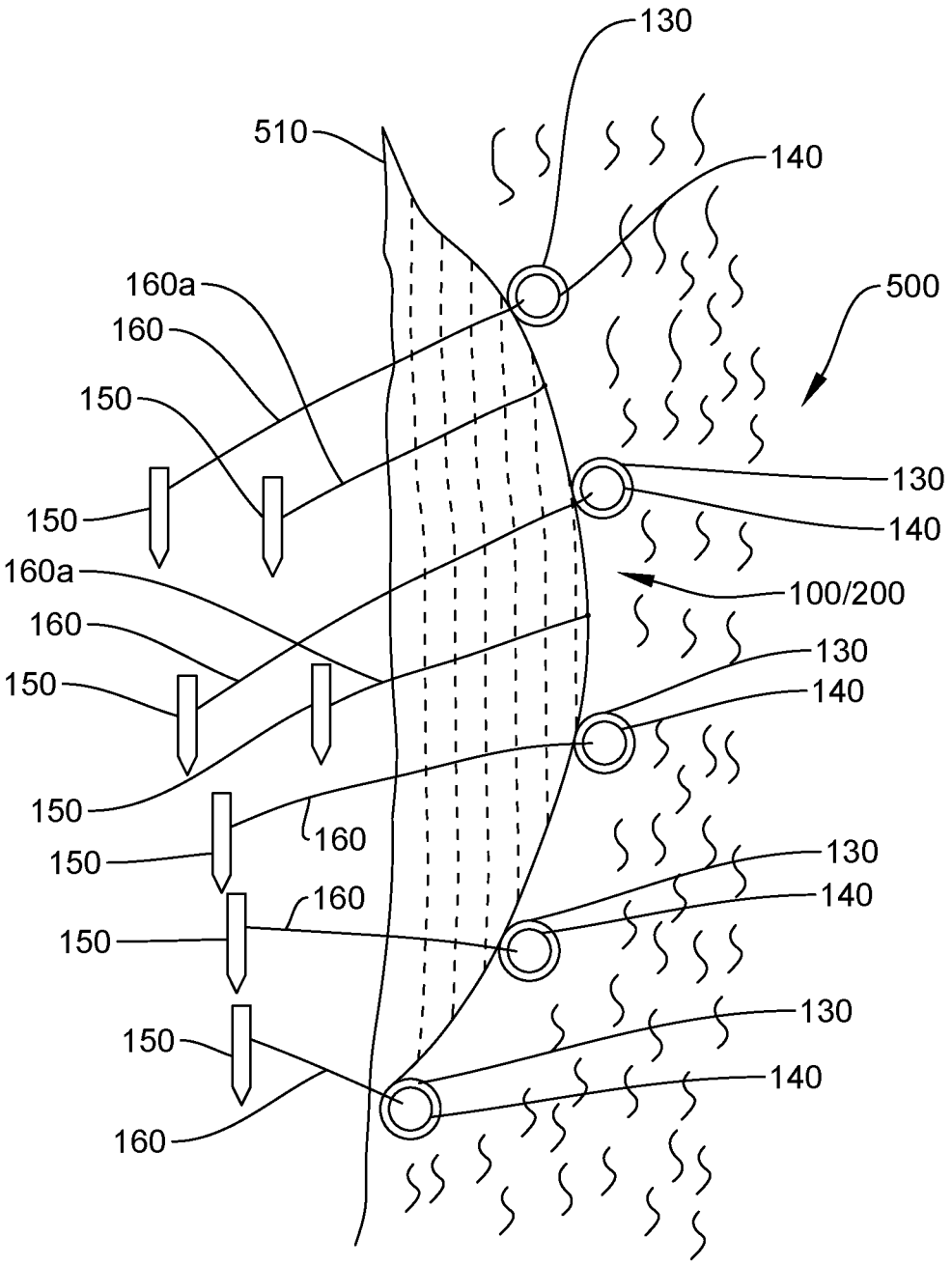
FIG. 5 is a top view of an in-water installation of a fence system according to some embodiments of the present invention.

In some embodiments, to improve the ability of the fence systems of the present invention (e.g., 100 or 200) to withstand the impact of high flow of silt, such as a water system 500 having a bank 510, as illustrated in FIG. 5, reinforcing ropes 160 can be used to tie the mounting posts 140 to anchoring stakes 150 installed on the solid ground on the bank 510 and away from the installation location of the fence. Additionally or alternatively, one end of reinforcing ropes 160*a* can be coupled to the draw cord 116 near the upper edge of the wall panel portion 110 (e.g., through opening 119 shown FIG. 2A), and the other end of reinforcing ropes 160*a* are tethered to anchoring stakes 150 installed on the solid ground on the bank 510. A similar configuration of tying ropes and anchoring stakes can be used for installing the fence system in other locations (and not in water), such as a construction site, the foot of a slope where soil erosion is underway or expected.

In some embodiments, reflective tags or indicators can be included in the fence system described herein to increase visibility of the fence system, especially at low light condition. The reflective tags or indicators can be in the form of tapes, ribbons, a reflective coating, etc., which can be installed, attached, applied, or otherwise secured on the fabric, the anchoring stakes, the securing ropes, and/or other parts of the fence system.

The description provided herein is not to be limited in scope by the specific embodiments described which are intended as single illustrations of individual aspects of certain embodiments. The methods, compositions and devices described herein can comprise any feature described herein either alone or in combination with any other feature(s) described herein. Indeed, various modifications, in addition to those shown and described herein, will become apparent to those skilled in the art from the foregoing description and accompanying drawings using no more than routine experimentation. Such modifications and equivalents are intended to fall within the scope of the appended claims.

The invention claimed is:

1. A fence system comprising:

a wall panel portion having an upper edge and a lower edge, wherein the wall panel comprises a first channel proximate the upper edge in which a first draw cord is threaded, and a second channel proximate the lower edge in which a second draw cord is threaded;

a plurality of tubular pockets running across the wall panel between the upper edge and the lower edge, the tubular pockets each configured to receive a mounting post therein; and a plurality of securing stakes each including a bent portion configured to directly engage the outside of the second channel to thereby hold the second draw cord to the ground, and a pointed tip for penetrating into the ground.

2. The fence system of claim 1, wherein the wall panel portion and the apron portion are formed of a one-piece flexible fabric material.

3. The fence system of claim 2, wherein the flexible fabric material is a knitted polyethylene material.

4. The fence system of claim 1, wherein the wall panel portion is formed of a knitted polyethylene material.

5. The fence system of claim 1, further comprising at least one grommet near the upper edge and proximate to one of the plurality of tubular pockets.

6. The fence system of claim 1, wherein at least one of the tubular pockets is attached to the wall panel portion.

7. The fence system of claim 1, wherein at least one of the tubular pockets is formed by a fold of the wall panel portion.

8. The fence system of claim 1, further comprising a plurality of mounting posts each inserted in one of the tubular pockets.

9. The fence system of claim 1, wherein at least one of the mounting posts is coupled to the wall panel portion by a fastening tie.

10. The fence system of claim 9, wherein the wall panel portion comprises a grommet, and the fastening tie includes an elongated element passing through the grommet.

11. The fence system of claim 9, wherein at least one of the mounting posts comprises a through hole, and the fastening tie includes an elongated element passing through the through hole.

12. A fence installation comprising:

a wall panel portion having an upper edge and a lower edge, wherein the wall panel comprises a first channel proximate the upper edge in which a first draw cord is threaded, and a second channel proximate the lower edge in which a second draw cord is threaded;

a plurality of tubular pockets running across the wall panel between the upper edge and the lower edge, the tubular pockets each configured to receive a mounting post therein;

a plurality of mounting posts each inserted in one of the plurality of tubular pockets and with one end driven to the ground; and a plurality of securing stakes each including a pointed tip penetrated into the ground, and a bent portion directly engaging the outside of the second channel and holding the second draw cord to the ground.

* * * * *